US011957952B2

(12) United States Patent
Do

(10) Patent No.: US 11,957,952 B2
(45) Date of Patent: Apr. 16, 2024

(54) MODULAR HOME GYM

(71) Applicant: MacroFit, Inc., Los Angeles, CA (US)

(72) Inventor: Tyler Do, Burbank, CA (US)

(73) Assignee: MACROFIT, INC., Los Angeles, CA (US)

( * ) Notice: Subject to any disclaimer, the term of this patent is extended or adjusted under 35 U.S.C. 154(b) by 0 days.

(21) Appl. No.: 17/397,631

(22) Filed: Aug. 9, 2021

(65) Prior Publication Data

US 2022/0040519 A1 Feb. 10, 2022

Related U.S. Application Data

(60) Provisional application No. 63/063,796, filed on Aug. 10, 2020.

(51) Int. Cl.

| | |
|---|---|
| ***A63B 21/00*** | (2006.01) |
| ***A63B 1/00*** | (2006.01) |
| ***A63B 23/12*** | (2006.01) |

(52) U.S. Cl.

CPC ..... *A63B 21/4037* (2015.10); *A63B 1/00* (2013.01); *A63B 23/1218* (2013.01); *A63B 23/1227* (2013.01); *A63B 23/1236* (2013.01); *A63B 2225/093* (2013.01)

(58) Field of Classification Search

CPC ..... A63B 1/00–005; A63B 21/068; A63B 21/4037; A63B 21/055–0557; A63B 21/16; A63B 21/4027; A63B 21/4029; A63B 21/4033; A63B 3/00; A63B 23/1218; A63B 23/1227; A63B 23/12–1236; A63B 2225/093; A63B 17/04; A63B 17/00; A63B 2071/027; A63B 2210/50

See application file for complete search history.

(56) References Cited

U.S. PATENT DOCUMENTS

| | | | | |
|---|---|---|---|---|
| 4,955,604 | A * | 9/1990 | Pogue | A63B 21/0783 482/99 |
| 5,226,868 | A * | 7/1993 | Montgomery | A63B 21/4035 482/141 |
| 5,417,636 | A * | 5/1995 | Havens | A63B 21/0552 482/145 |
| 6,220,994 | B1 * | 4/2001 | Rich | A63B 23/03508 482/130 |
| 8,905,905 | B2 * | 12/2014 | Mangalindan | A63B 23/1236 482/141 |
| 9,206,581 | B2 * | 12/2015 | Mollick | A63B 17/04 |
| 9,504,871 | B2 * | 11/2016 | Muñoz Saez | A63B 21/16 |
| 9,545,537 | B2 * | 1/2017 | Savioli | A63B 21/16 |
| 10,709,921 | B2 * | 7/2020 | Risacher | A63B 17/04 |
| 11,083,923 | B2 * | 8/2021 | Potapov | A63B 69/0062 |
| 2004/0002394 | A1 * | 1/2004 | Heipp | A63B 17/00 472/136 |

(Continued)

FOREIGN PATENT DOCUMENTS

WO WO-2020102849 A1 * 5/2020

*Primary Examiner* — Megan Anderson
*Assistant Examiner* — Kathleen M Fisk
(74) *Attorney, Agent, or Firm* — Womble Bond Dickinson (US) LLP

(57) ABSTRACT

A modular home gym can include a platform with one or more holes that mate with one or more mating portions of attachable and removable exercise attachments. A variety of exercise attachments can be connected to the platform in a variety of configurations. Other embodiments are described.

17 Claims, 11 Drawing Sheets

(56) References Cited

U.S. PATENT DOCUMENTS

| | | | | |
|---|---|---|---|---|
| 2011/0152046 | A1* | 6/2011 | Rochford | A63B 21/16 482/131 |
| 2013/0225372 | A1* | 8/2013 | Rochford | A63B 21/0442 482/129 |
| 2014/0162853 | A1* | 6/2014 | Kadar | A63B 23/03541 482/130 |
| 2016/0023035 | A1* | 1/2016 | Meyer | A63B 1/00 482/38 |
| 2016/0067540 | A1* | 3/2016 | Dill | A63B 23/1245 482/129 |
| 2018/0085623 | A1* | 3/2018 | Flook | A63B 21/0557 |
| 2021/0205660 | A1* | 7/2021 | Shavit | G06V 40/23 |
| 2022/0008785 | A1* | 1/2022 | Hao | A63B 21/4035 |
| 2022/0168605 | A1* | 6/2022 | Janicki | A63B 17/00 |

* cited by examiner (TOP VIEW)

(TOP VIEW)

(PERSPECTIVE VIEW)

MODULAR HOME GYM

CROSS REFERENCE TO RELATED APPLICATIONS

This application claims the benefit of U.S. Provisional Patent Application No. 63/063,796 filed Aug. 10, 2020, which is incorporated by reference herein in its entirety.

FIELD

An embodiment of the disclosure relates to exercise equipment. In some embodiments, the disclosure relates to a modular home gym.

BACKGROUND

Options for personal gym equipment are limited. Some options can be described as "multi-use" or "all-in-one" systems. This equipment offers the ability to perform varying exercises, however, this type of equipment tends to be large and bulky. Large and heavy pieces of equipment take up valuable space, and require significant assembly and are mostly stationary once assembled. Further, this type of equipment can be limited in terms of add-ons or attachments for different exercises. Further, such equipment is difficult to move around (e.g., from one room to another, pack into a vehicle, assemble and disassemble at a park). This can be particularly burdensome for personal trainers who might wish to bring equipment to a client's house.

Other personal gym equipment tends to focus on specific exercises (e.g., abs, pull-ups, dips, push-ups). With this "exercise-specific" equipment, if a user wanted to do push-ups, dips, and pull-ups they would need three individual pieces of equipment that all have their own footprint. This focused equipment can be harder to store and transport, considering all the individual pieces of equipment. Further, each new exercise is a new investment as opposed to an add-on to an existing or centralized modular gym system.

SUMMARY

The present disclosure relates to a modular home gym having a "pegboard" style platform. This platform serves as the central unit to which different exercise specific attachments can be inserted or slotted into place. The unique design of the system allows such attachments to be inserted, used, and removed without the use of tools, snaps, or clamps to hold the attachments in place.

Such a system provides the ability to perform various exercises with different attachments, while maintaining a common footprint. For example, if a user wants to perform dips, push-ups, and pull ups, they would need either a fairly large, all-in-one "rig" that offers design features specific to each exercise or multiple different pieces of equipment. As discussed, the "all-in-one" equipment offers the space saving of a common footprint, but lacks in portability, ease of assembly/disassembly for storage, and is typically more expensive.

Individual "exercise specific" equipment allows for easier portability for each individual equipment, but can require more space as there are different pieces of equipment with their own bases/footprints. These are harder to store or transport since there are multiple individual parts and are typically less stable since they are stand-alone units.

A modular home gym system, as described in the present disclosure, offers the best of both worlds. Such a system has a singular footprint. Attachments can be added, used, removed, and/or purchased as needed so the user can customize to their specific needs. The solid base (a platform) provides improved support for attachments over individual dip bars that can tilt and tip. The system offers portability because attachments do not need a "base support" (as described in other sections). The attachments can be easily and efficiently stowed away or packed. The modular system described in the present disclosure allows for endless attachment options from dip bars to pull-ups, to table legs.

In some embodiments, a modular home gym includes: a platform having one or more holes located on a top facing surface of the platform; and one or more exercise attachments, each exercise attachment having one or more mating portions. Each mating portion is attachable and removable to a corresponding one of the one or more holes, thus allowing easy assembly, re-configuration, and/or disassembly of the system.

The above summary does not include an exhaustive list of all embodiments of the present disclosure. It is contemplated that the disclosure includes all systems and methods that can be practiced from all suitable combinations of the various embodiments summarized above, as well as those disclosed in the Detailed Description below and particularly pointed out in the Claims section. Such combinations may have particular advantages not specifically recited in the above summary.

BRIEF DESCRIPTION OF THE DRAWINGS

Several embodiments of the disclosure here are illustrated by way of example and not by way of limitation in the figures of the accompanying drawings in which like references indicate similar elements. It should be noted that references to "an" or "one" embodiment in this disclosure are not necessarily to the same embodiment, and they mean at least one. Also, in the interest of conciseness and reducing the total number of figures, a given figure may be used to illustrate the features of more than one embodiment of the disclosure, and not all elements in the figure may be required for a given embodiment.

DETAILED DESCRIPTION

Several embodiments of the disclosure with reference to the appended drawings are now explained. Whenever the shapes, relative positions and other embodiments of the parts described are not explicitly defined, the scope of the invention is not limited only to the parts shown, which are meant merely for the purpose of illustration. Also, while numerous details are set forth, it is understood that some embodiments of the disclosure may be practiced without these details. In other instances, well-known structures, and techniques have not been shown in detail so as not to obscure the understanding of this description.

A modular home gym, or modular exercise equipment, can include a platform that has one or more holes that serve as receptacles that mate with one or more exercise attachments (e.g., pull-up station attachments, push-up station attachments, dip station attachments, and more). The exercise attachments can be attachable and removable from the platform without requiring any fasteners such as, for example, bolts, nuts, screws, latches or clasps. The exercise attachments can be attachable and removable, without requiring tools and without removing parts. For example, while it is understood that with the right tools (e.g., a wrench, a screw driver, a saw, a crowbar, etc.) most mechanical parts can be attached and removed from an assembly, what is meant here is that a user can attach and remove the exercise equipment manually without use of tools and without removing parts (e.g., bolts, screws, nuts, nails, etc.).

Figure 1:
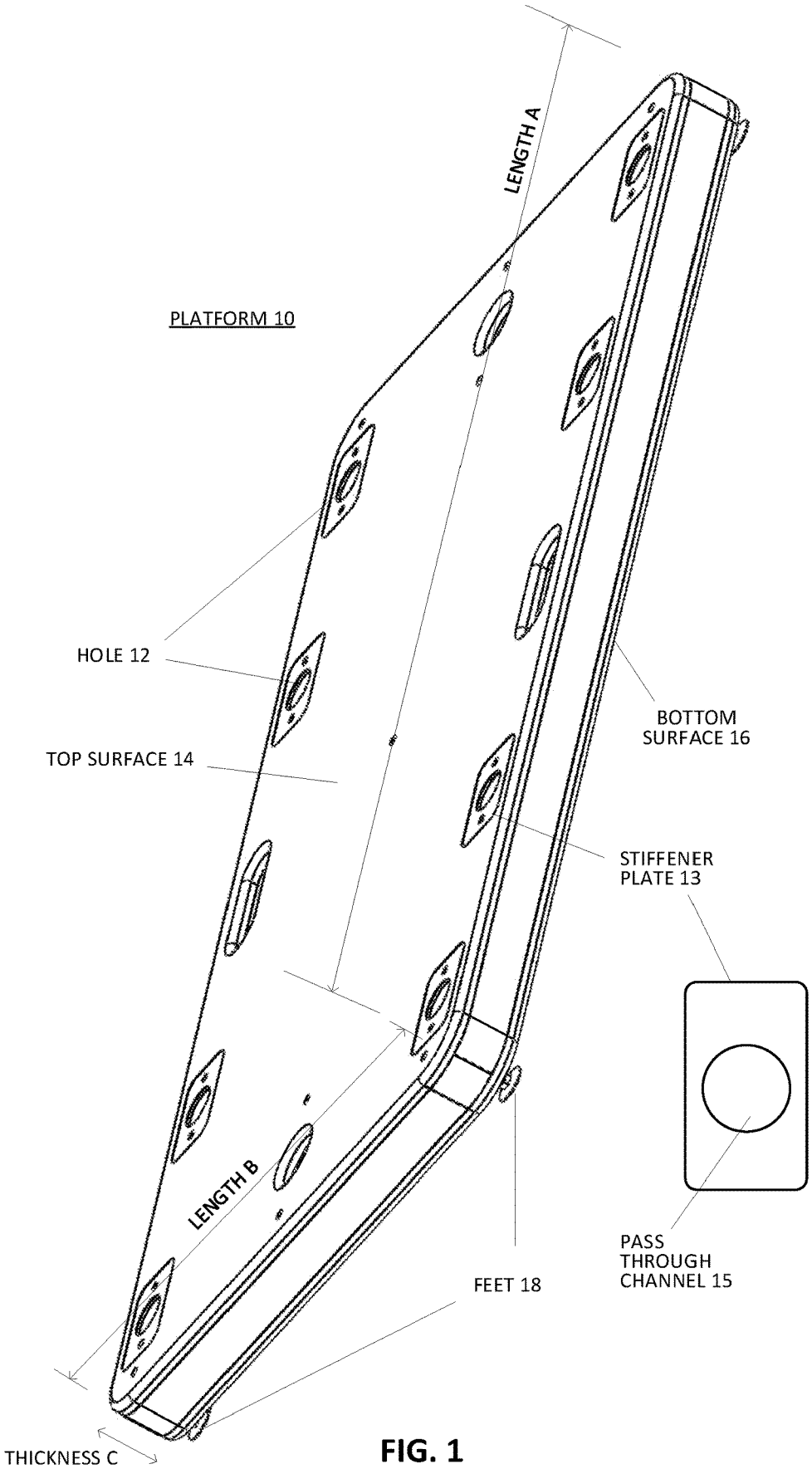
FIG. 1 shows a platform of a modular home gym, according to some embodiments.

As shown in FIG. 1, the system can include a common "peg board" style platform or base to which varying exercise specific attachments can be inserted. This "peg board" platform mitigates the need for clamps, snaps, or flanges which can reduce cost and complexity of the platform and attachments, while maintaining strength and a low profile having a compact footprint (e.g., when used and/or stored).

The platform 10 has one or more holes 12 arranged on a top surface 14 of the platform. The platform is designed to lay flat on a surface (e.g., the floor of a living room or garage or dirt or cement ground outdoors). When the platform lays on the surface, the top surface faces up, away from the surface on which it lays.

In some embodiments, the platform is substantially flat or planar. In some embodiments, the top surface has a rectangular shape. In some embodiments, the rectangular shape has rounded corners. In some embodiments, the platform can have a length A ranging from 36" to 72", or from 40" to 66" or from 44" to 55".

In some embodiments, length A is 48". In some embodiments, length B is shorter than length A. In some embodiments, length B can range from 18" to 48" or from 20" to 36" or from 24" to 30". In some embodiments, length B is 24". The platform can have a thickness C measured from the top surface to the bottom surface of the platform. It should be understood that dimensions described in the present disclosure can vary to some degree (e.g., a small, medium, and large variety) without departing from the scope of the present disclosure.

In some embodiments, a stiffener plate 13 is arranged over each hole. The stiffener plate has a pass through channel 15 that allows mating members of the attachments to enter the hole. The pass through channel can be arranged along a perimeter of the opening of each hole, (e.g., substantially flush with the hole walls) to provide strength where needed. The plates are sized based on the size of the holes, which, in turn, are sized to be just large enough to receive attaching members of the exercise attachments, as described in other sections. For example, the holes can be roughly the same size but slightly larger than the cross-section of each mating portion of an attachment. The shape of the holes of the platform and the shape of mating members of the attachments can be complementary, so the mating members fit in the respective holes in a snug manner. Although shown as circular in some of the figures, the holes and mating members can have other complimentary shapes such as square, diamond, rectangular, triangle, D-shaped, polygonal, or other shape. Each stiffener plate can be fixed to the platform using an adhesive, and/or one or more fasteners (e.g., screws, bolts), or other fixing technique.

The stiffening plates can be made of a sufficiently stiff and strong material such as metal (e.g., steel, iron, copper, aluminum, or other metal or metal alloy). The plates provide strength where it is needed, while allowing the rest of the platform (away from the holes) to be formed from a different, lighter material. Without such plates, softer materials (e.g., wood, plastic, etc.) could deform under load and repeated use. The plates provide the strength characteristics of a metal flange or tube over tube connection, but reduce the need for additional hardware (flange) or keyed features, holes, and snaps/screws (tube over tube). Thus, in some embodiments, the platform does not include any clamps, snaps, or flanges, because the plates provide sufficient strength.

A bottom surface 16 of the platform faces the floor. In some embodiments, the platform can have one or more feet 18 to provide stability to the platform. In some embodiments, the feet are adjustable, so that a user can level the platform on uneven surfaces.

Figure 2:
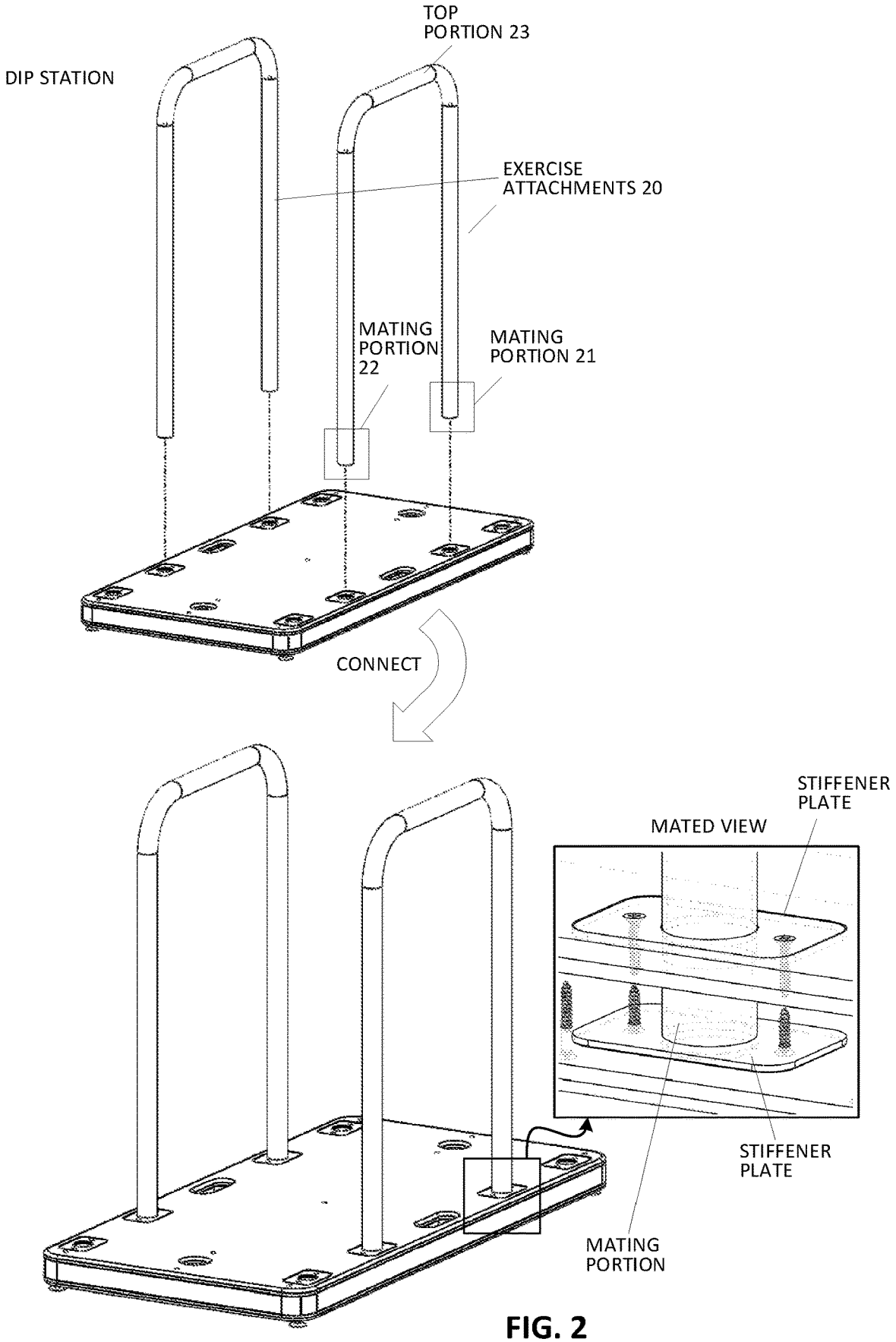
FIG. 2 shows a platform of a modular home gym with exercise attachments, according to some embodiments.

Referring to FIG. 2, the system can include at least one attachable and detachable exercise attachment which has a geometry tailored to one or more specific exercises. For example, attachments 20 can form a dip station when connected to the platform. The dip station attachments can be connected to the platform by insertion of one or more mating portions (21 and 22) of the attachments into the holes of the platform. In some embodiments, the exercise attachments can be formed from one or more tubes, which can be hollow in one or more sections. In some embodiments, the tubes can be bent to form a shape (e.g., a U shape). Additionally, or alternatively, tubes are connected together (e.g., through welding or fasteners).

In some embodiments, as shown in FIG. 2, an exercise attachment 20 is a U shaped tube having a first end that forms a first mating portion 21 and a second end that forms a second mating portion 22. Each mating portion of the exercise attachment fills the depth of the hole of the platform to provide a secure connection between the exercise attachment and the platform. Gravity substantially holds the attachment in place, without the user of fastening elements.

In some embodiments, the depth of the hole is at least 1.5". In some embodiments, the depth of the hole is 2". In some embodiments, the depth of the hole is greater than 2". In some embodiments, the end portions of each tube can be capped so that the interior of the tube is not exposed and to provide structural integrity and resistance to deformation at the ends of the attachment.

As shown in the mated view of FIG. 2, the mating portion can extend through a length of the hole. In this example, the mating portion extends through a first stiffener plate positioned at the entrance of the hole and a second stiffener plate arranged beneath the top surface (e.g., at the bottom of the hole). The stiffener plates in this example can provide strength at the top and bottom of the connection, thereby providing strength to the hole where it is especially needed.

In some embodiments, the exercise attachment 20 includes a top portion 23 of the attachment, which can be horizontal, inclined, or declined, with respect to the platform when attached. The top portion transitions to a first leg on one side and a second leg on the other side. The lengths of the legs determine the height of the top portion of the exercise attachment relative to the platform. The length of the top portion and the legs can vary depending on the targeted exercise. The height of the top portion of the exercise attachment in a dip station can range, for example, from 28" to 40", or from 32" to 36". In some embodiments, the height of the top portion is 33". The length of the top portion can range, for example, between 15" and 30". In some embodiments, the system includes a plurality of exercise attachments with varying geometry (e.g., different lengths of legs and top portions) to accommodate different exercises.

Figure 9:
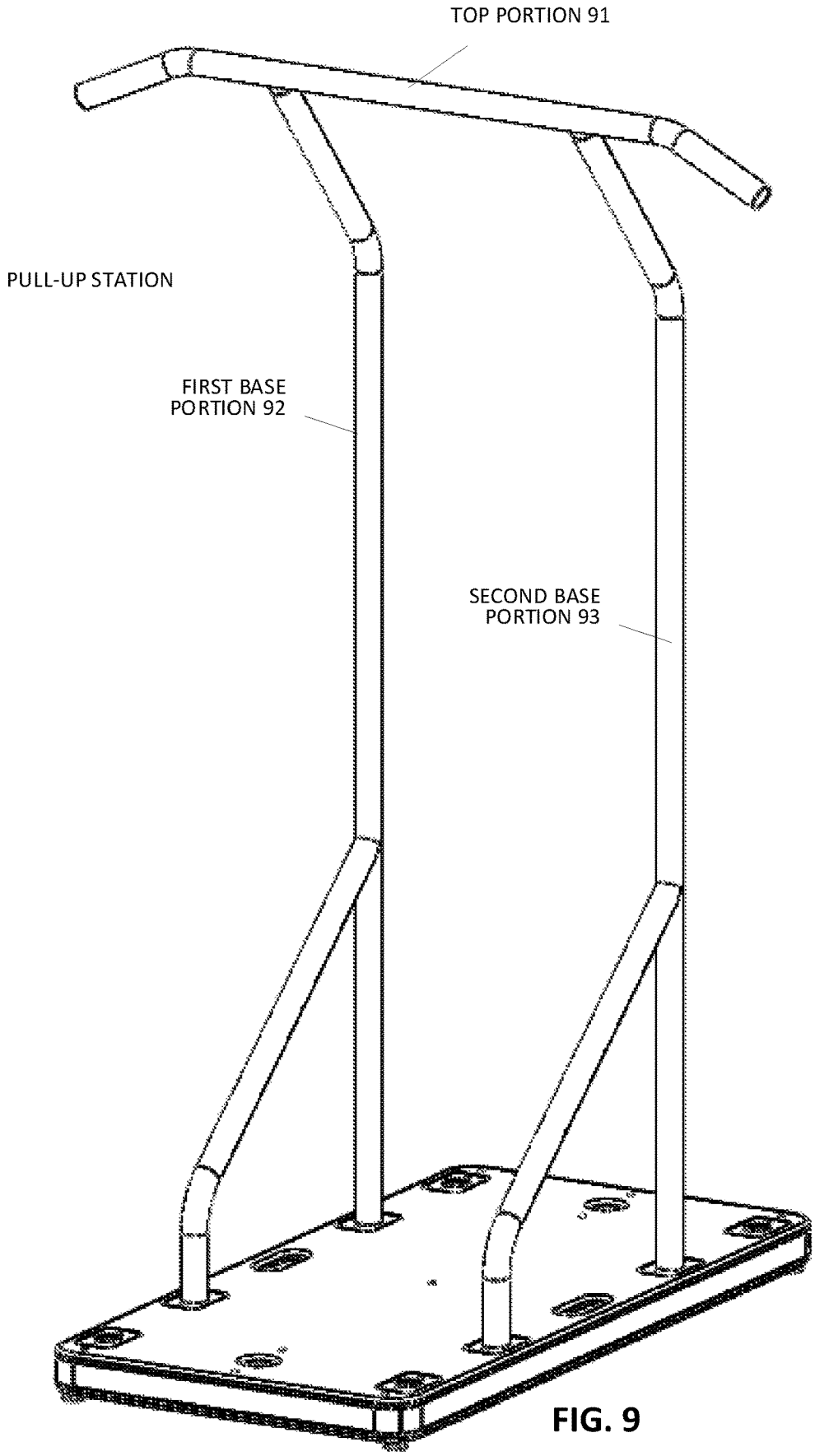
FIG. 9, FIG. 10, FIG. 11, FIG. 12, and FIG. 13 show exercise attachments of a modular home gym, according to some embodiments.

In some embodiments, an attachment or attachments can form a pull-up station as shown in FIG. 9. The attachment or attachments can include a top portion 91 that is raised above the platform at a comfortable height, e.g., overhead. The attachment or attachments can include a first base portion 92 and a second base portion 93. Each of the first base portion and the second base portion can have two or more mating portions that mate with corresponding holes of the platform, to secure the attachment against various dynamic forces that can be present when used for pull-ups and other exercises. Top portion 91 can be raised by and held between the first base portion and the second base portion. When the pull up station is assembled to the base, the top portion 91 can be parallel with the base, also making it parallel with the ground in which the base lays.

In some embodiments, the top portion 91 has a height that ranges from 60" to 80" or from 65" to 75". In some embodiments, the height is 68", 70" or 72". In some embodiments, attachments for this pull-up station can be assembled and disassembled to improve storage and transport footprint. For example, the top portion can be removed from the first base portion and the second base portion. Each of the top portion, the second base portion, and the first base portion can be substantially planar (e.g., flat) in at least one dimension when disconnected. Thus, unlike some equipment which has members fixed along three different axis (e.g., an x, y, and z axis in a three-dimensional coordinate system), the system can be relatively easy to store when disassembled because each of the parts (including the platform and the attachments) can lay flat in at least one direction.

Figure 10:
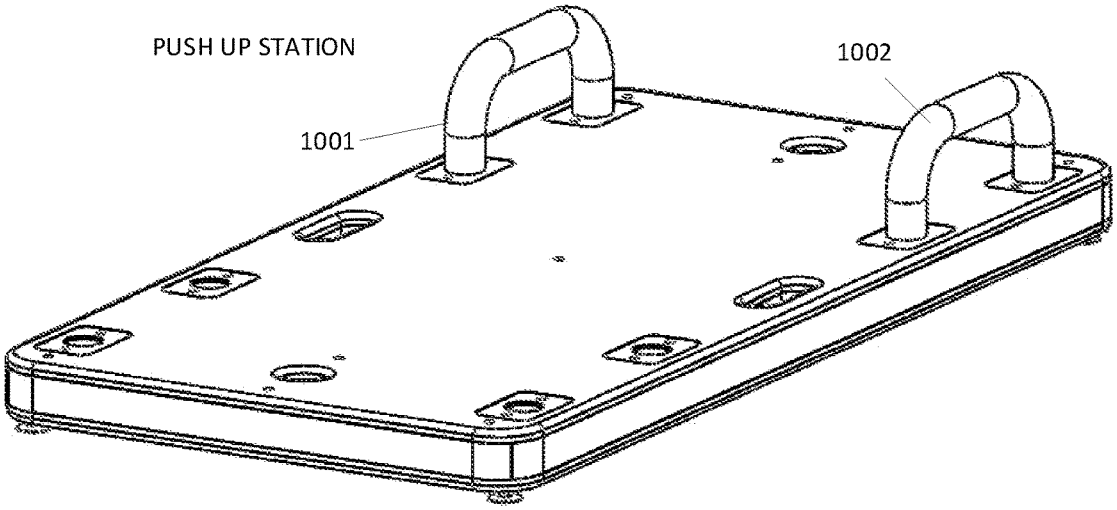

In some embodiments, a push-up station is shown in FIG. 10. The attachments of a push-up station can have dimensions for legs and top portions that are shorter for those of a dip station. A height (relative to the platform) of the top portion of each push-up attachment 1001 and 1002 can range, for example, from 2" to 10" or from 4" to 8". In some embodiments, the height is 4", 6" or 10". A length of the top portion can range, for example, from 6" to 12".

Figure 11:
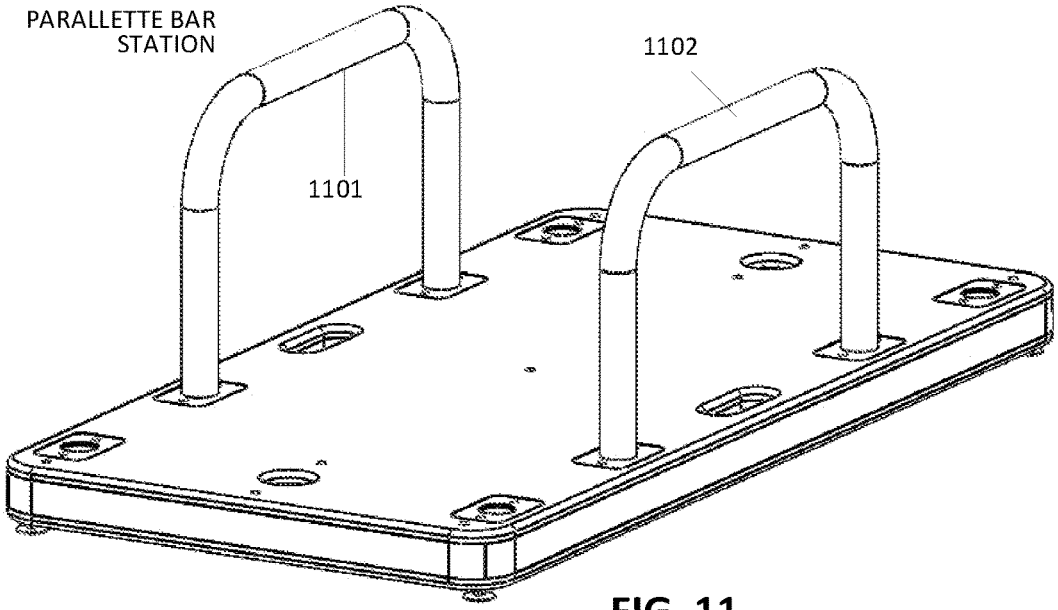
Figure 12:
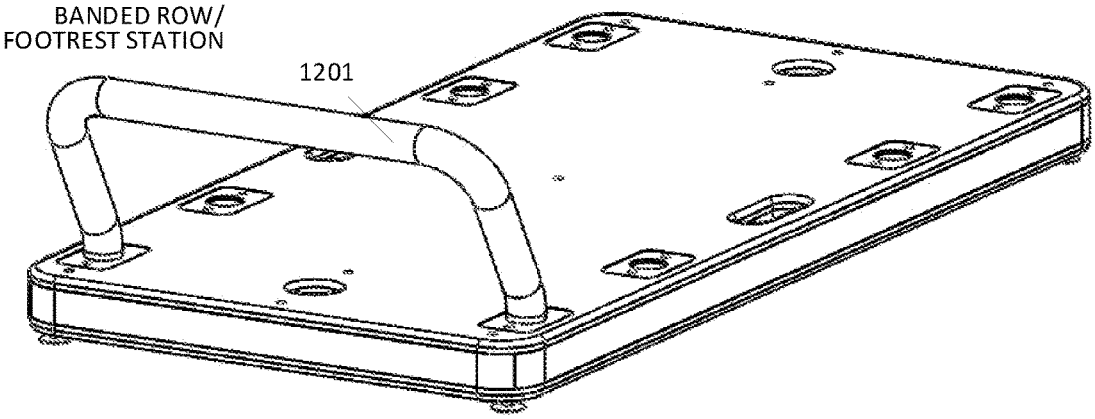

In another example, a parallette bar station is shown in FIG. 11. The height (relative to the platform) of the top portion of each push-up attachment 1101 and 1103 can range, for example, from 10" to 16" or from 12" to 14". In some embodiments, the height is 12", 14" or 16". In some embodiments, the length of the top portion of the attachments 1101 and 1102 can range from 15" to 25". In some embodiments, the length is 20". In another example, as shown in FIG. 12, a banded row/footrest attachment 1201 is shown.

The modular home gym allows for full customization—a user can configure the platform to target different exercises. Further, the same exercise station (e.g., dips or push-ups) can be adjusted with different geometries, e.g., with widening or narrowing spacing between grips, as discussed in other sections. The flat planar geometry of the platform and the attachments allow for easy stowage, portability, and transport.

Figure 3:
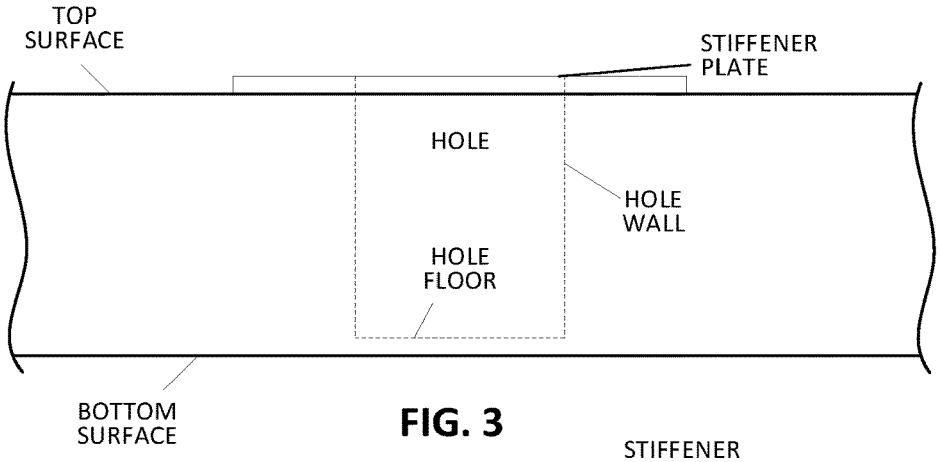
FIG. 3, FIG. 4, FIG. 5, and FIG. 6 show hole and stiffener plate of a modular home gym, according to some embodiments.

FIGS. 3-6 show various embodiments of the platform, holes, and stiffener plates. In FIG. 3, a stiffener plate is positioned on over a top surface of the platform at an entrance of the hole. The stiffener plate can have a pass through channel or opening that aligns with the hole wall in a substantially flush manner.

Figure 4:
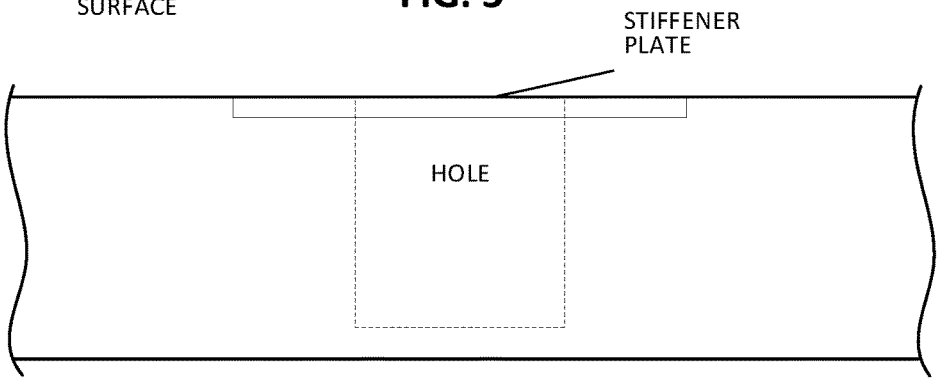
Figure 5:
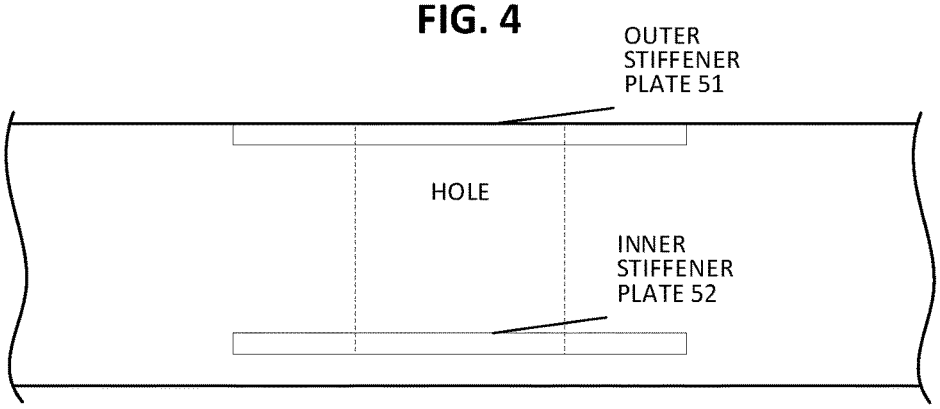

In FIG. 4, the stiffener plate is positioned within the platform (e.g., in a carved out portion of the top surface of the platform). The top surface of the stiffener plate can be substantially flush with the top surface of the platform to provide an overall smooth surface on the platform. In FIG. 5, an outer plate 51 is positioned at the opening of the hole, and an inner stiffener plate 52 is positioned below the surface (e.g., at the floor or bottom of the hole). As mentioned, this stiffener arrangement can provide strength to the hole where it is especially needed.

Figure 6:
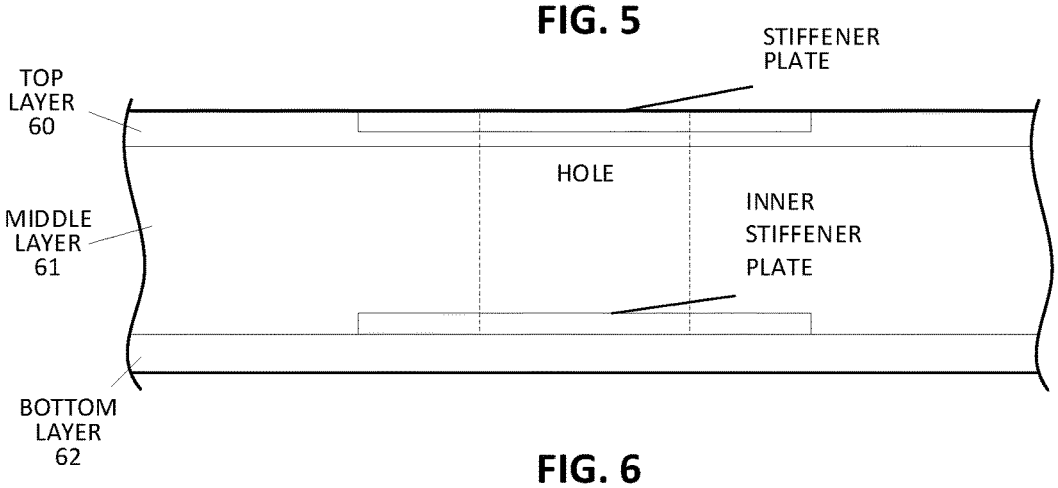

In FIG. 6, the platform can include a top layer 60 that is positioned at the top surface of the platform. The top layer can be, for example, a ply-wood, a polymer, a metal, or other suitably strong and light material. The middle layer 61 can be formed from wood, polymer, or other suitably strong and light material. The bottom layer 62 can be formed from the same material as the top layer. In some embodiments, the inner stiffener plate is positioned in the middle layer being in-contact with the bottom layer, or in the bottom layer in-contact with the middle layer. In some embodiments, the hole is present through the top layer and all of or some of the middle layer, but not the bottom layer. This allows for systematic hole machining of the top and middle layers while excluding hole machining with respect to the bottom layer.

In some embodiments, the platform can be coated or treated with water-resistant and/or UV resistant treatments such as stains, paint, acrylic, etc.

Figure 7:
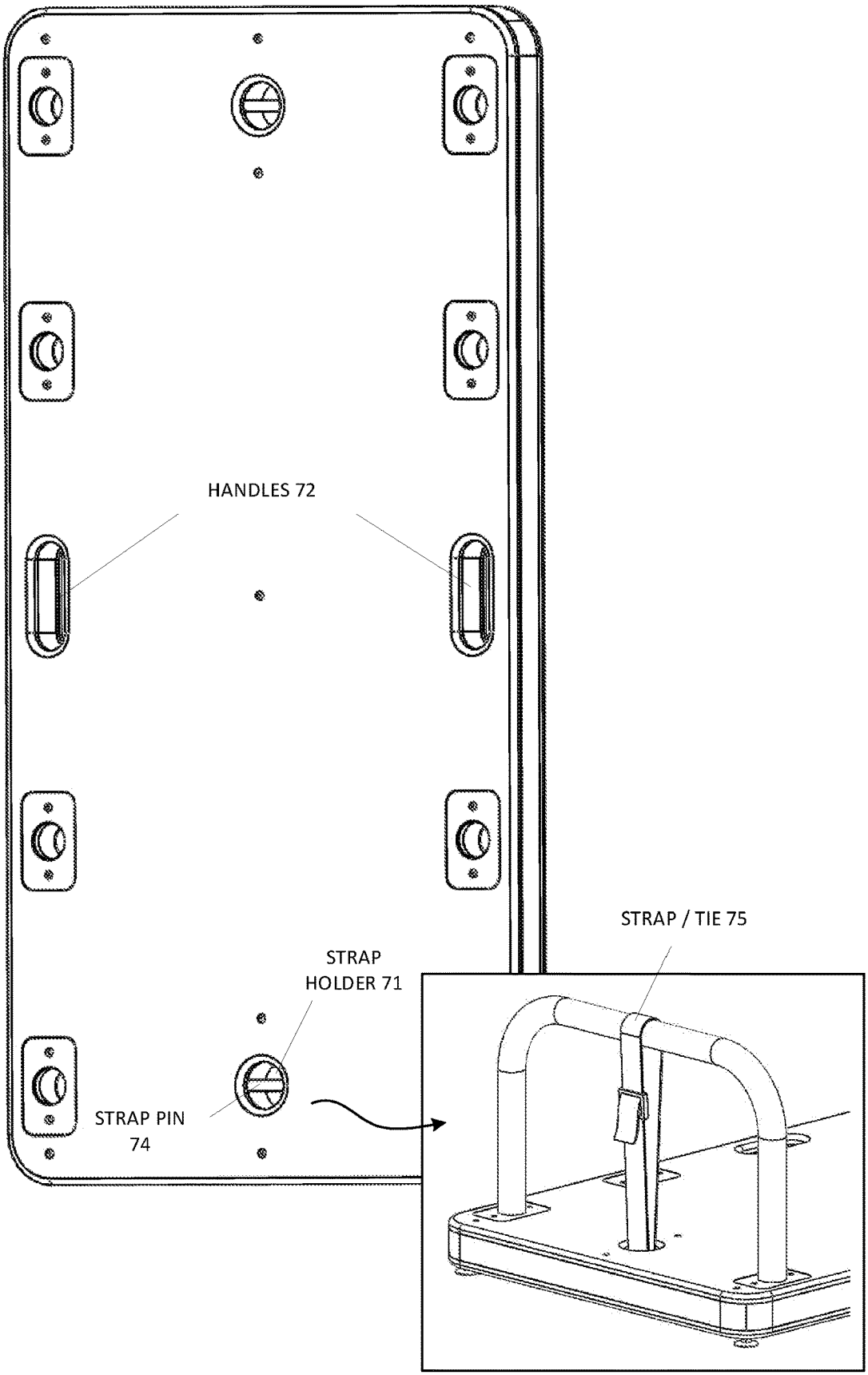
FIG. 7 shows a modular home gym with strap holder and handles according, to some embodiments.

Referring to FIG. 7, in some embodiments, the platform includes one or more handles 72 and/or one or more strap holders 71. The handles can include openings in the platform (rather than protruding members) that are sized to allow a hand to pass through. In some embodiments, the openings of the handles pass through the entire thickness of the platform, so that the platform can be gripped comfortably (e.g., with thumb and fingers on opposing surfaces of the platform).

The strap holder can include a cavity in which a strap pin 74 is fixed to. A strap or tie 75 can loop around or tie to the strap pin and also loop around or tie to an exercise attachment (as shown in FIG. 7). This can provide security to the exercise attachment for some exercises that could involve pulling or other upward forces. Due to position of the pin inside of the cavity, and the lack of protruding handles, the platform can remain substantially planar without protruding parts, which gives the platform a slim profile that allows it to be stored and transported with ease. In some embodiments, the system can include a strap, a tie, or resistance bands that exert a pulling force when stretched. In some embodiments, resistance bands are connected to the strap holder for banded exercises. In some embodiments, the strap holder is positioned between two of the one or more holes that are each positioned at corners of the platform, as shown in FIG. 7. Thus, a strap can hold an exercise attachment that is placed at the end of the platform, and that exercise attachment can serve as an anchor for exercises such as sit-ups or other exercises involving upward forces or pulling up.

Figure 8:
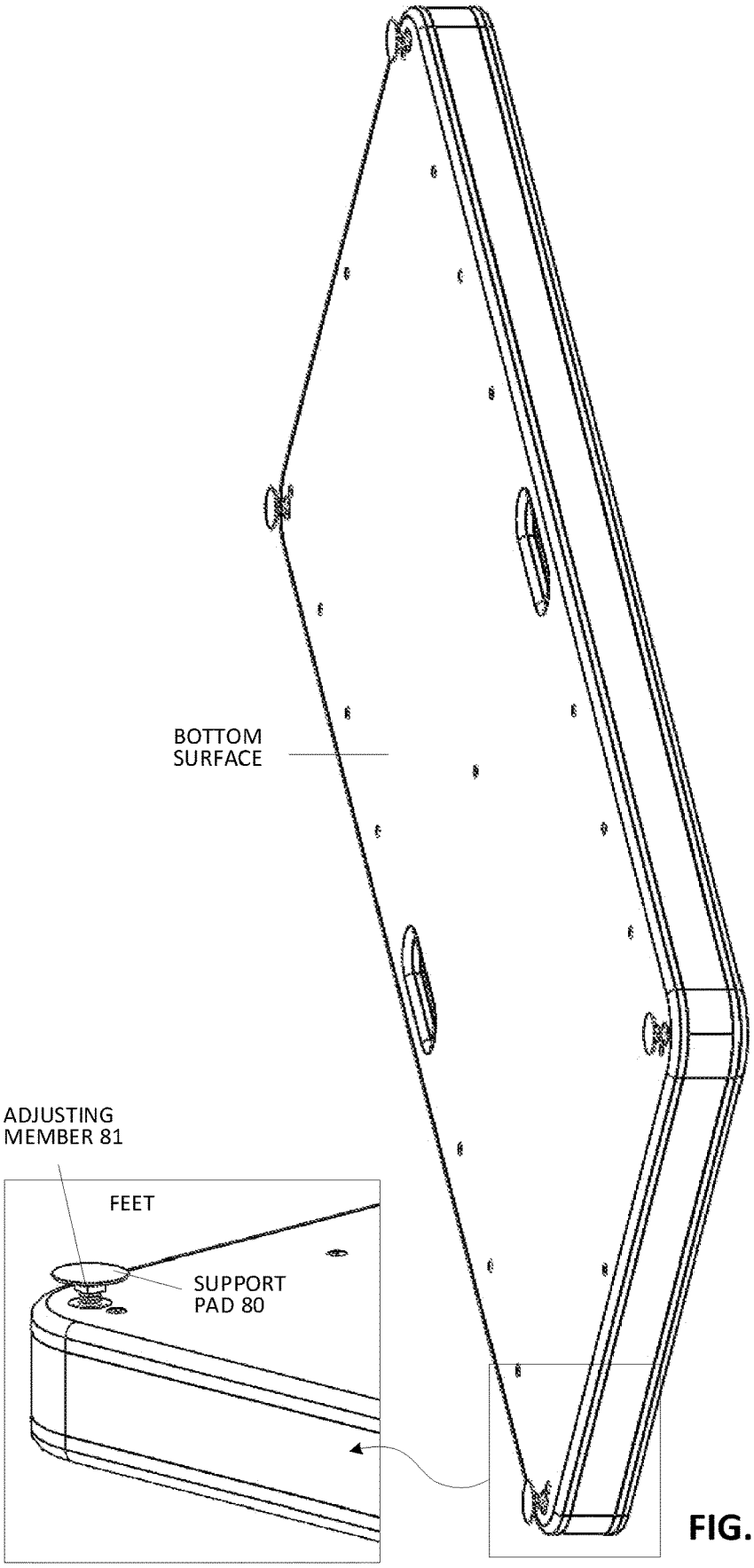
FIG. 8 shows a bottom surface of a platform of a modular home gym, to some embodiments.

FIG. 8 shows the bottom surface of the platform in some embodiments. The feet can be located at the bottom surface to provide a stable and level footing for the platform. In some embodiments, the feet have a support pad 80 which makes contact with the ground on which the system lays. The support pad can have a sufficiently wide footprint, for example, ranging from 0.5" to 1.5". In some embodiments, each foot includes an adjusting member 81 that adjusts the height of the feet. This can help level the platform on uneven surfaces. The adjusting member can include a threaded shaft that adjusts height based on rotation (e.g., rotation of the support pad). In some embodiments, the platform can have four feet. Each of the feet can be positioned at corner regions of the platform.

In some embodiments, the feet are attachable, removable, and replaceable. In some embodiments, feet can have smaller support pads and/or felt attached to the support pad, (e.g., for indoor use). For outdoor use, feet can have larger support pads and/or be made from steel or other weather-resistant material. A user can swap out the feet depending on application. The feet can be removed for storage purposes because the platform is slimmer without the feet protruding from the bottom surface. In some embodiments, a foot can be located at each of four corners of the platform.

Figure 13:
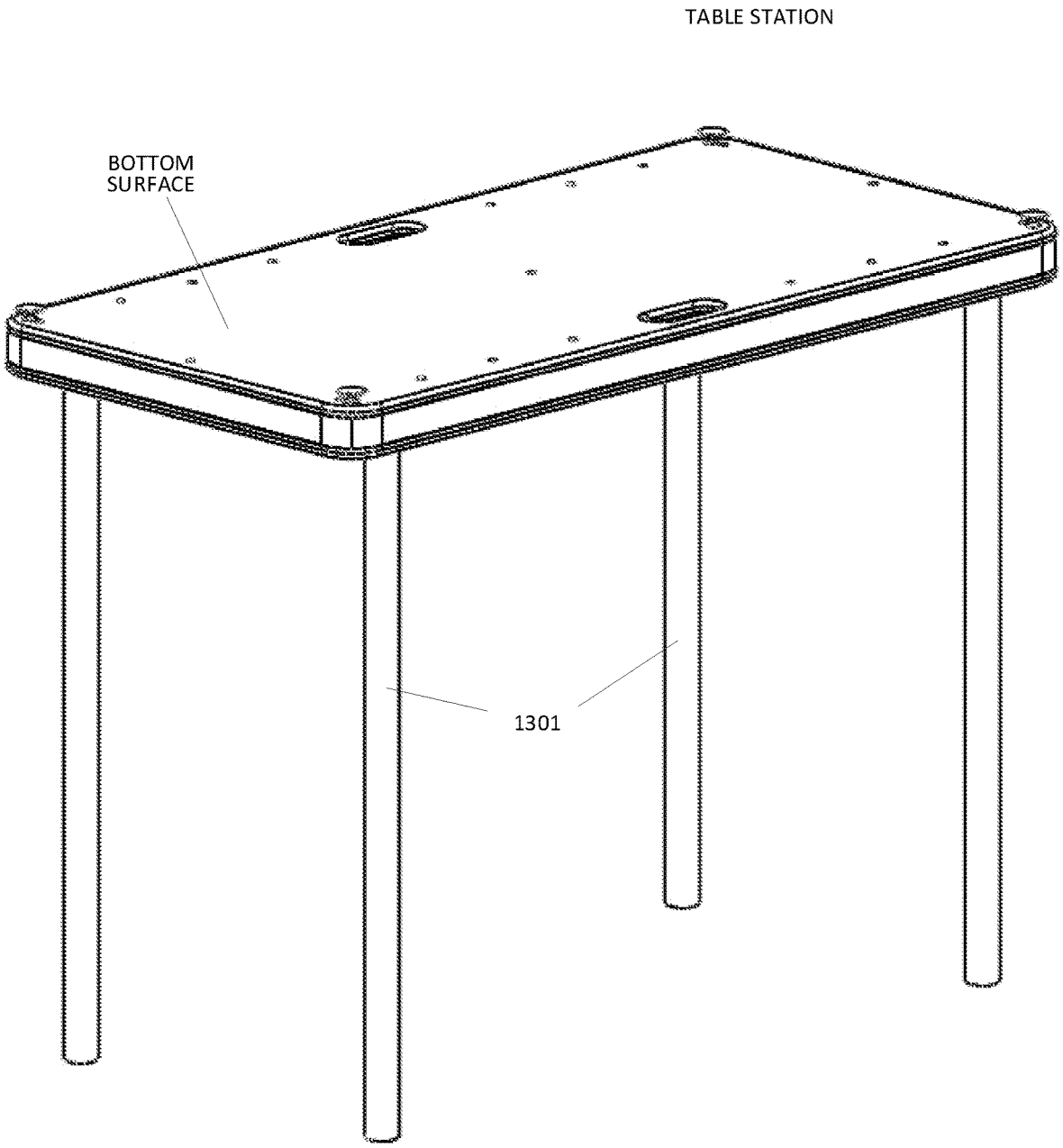

In some embodiments, as shown in FIG. 13, attachments 1301 can be connected to the platform to form a table station. The attachments in this embodiment form table legs and the platform serves as the table top. The bottom surface can, in this embodiment, be facing upward. Thus, the mobile home equipment can serve as a table when not needed for exercise. The feet of the platform can be removed (as described in other sections) to provide a flat, uninterrupted table surface.

In some embodiments, the platform has at least two holes. In some embodiments, the platform has 2-10 holes. In some embodiments, the platform has exactly 8 holes. The holes can be spaced apart at advantageous positions to provide flexibility in the exercises.

Figure 14:
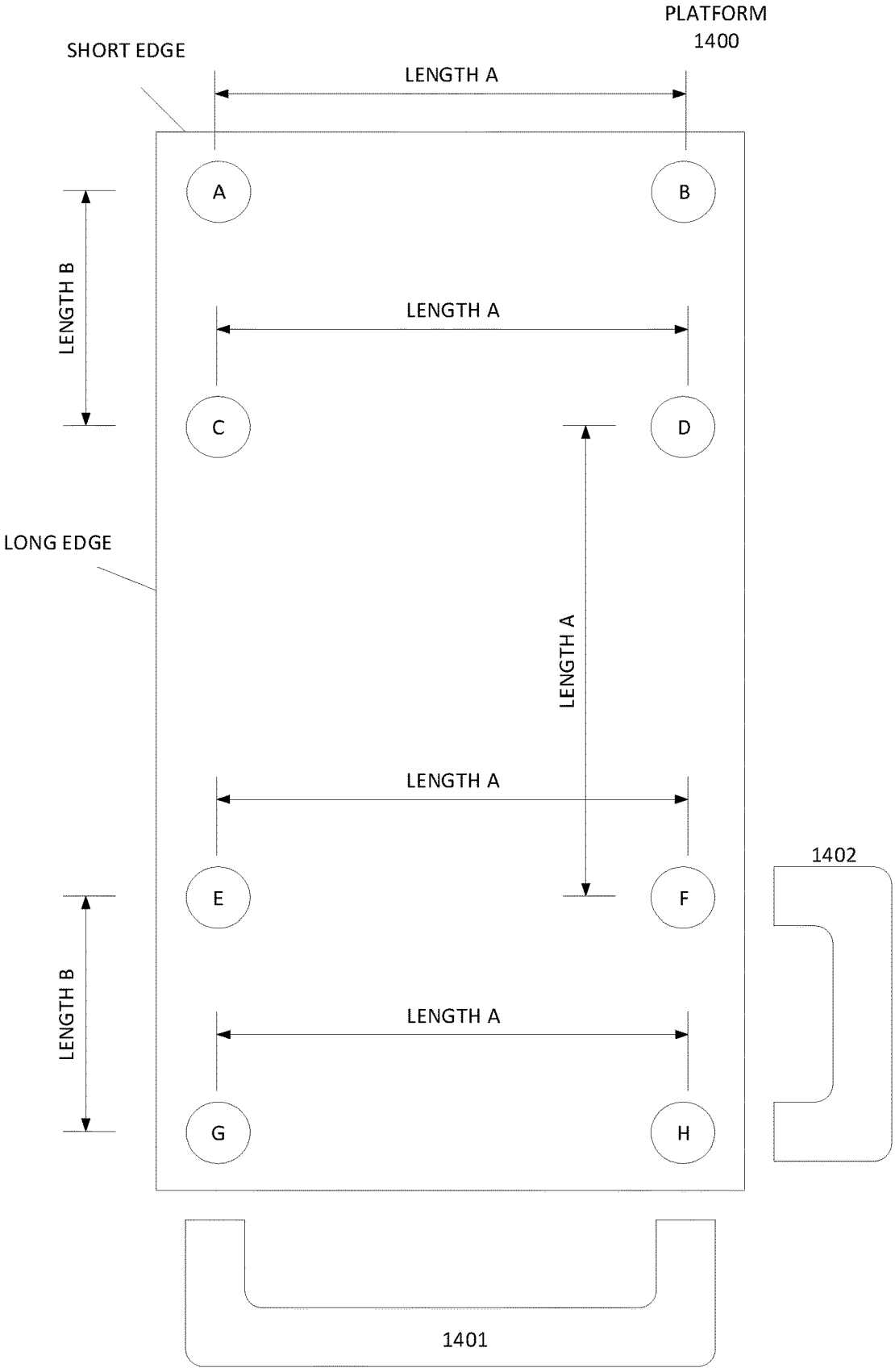
FIG. 14 shows holes of a platform of a modular home gym, according to some embodiments.

For example, as shown in FIG. 14, in some embodiments, platform 1400 can include eight holes (A-H). Hole pairs [A, B], [C, D], [E, F], [G, H], [C, E] and [D, F] can each be spaced a length X apart from each other. Thus, a same exercise attachment (e.g., attachment 1401) or a pair of those attachments having the mating members spaced length X apart from each other can attach to any of those hole pairs [A, B], [C, D], [E, F], [G, H], [C, E] and [D, F].

Hole pairs [A, C], [B, D], [E, G], and [F, H] can each be spaced a length Y apart from each other. Thus, the same exercise attachment (e.g., attachment 1402) or a plurality of such attachments can attach to any of those hole pairs. Thus, the platform can have hole pairs that provide different spacing to accommodate different length attachments and different positions for the same attachment.

In some embodiments, six hole pairs have a spacing of a length X (or a first length), and four hole pairs have a spacing of a length Y (or a second length). The spacing of the length X can be greater than length Y (e.g., twice as long). In some embodiments, the platform is rectangular, having two long edges and two short edges. In some embodiments, four holes (e.g., holes A, C, E, and G) are positioned near a first long edge of the platform, and four holes (e.g., holes B, D, F, and H) are positioned along a second long edge of the platform, opposite the first long edge. Each of the four holes on the first long edge is paired with a corresponding hole on the second long edge (e.g., pairs [A, B], [C, D], [E, F], and [G, H]) with a spacing of length X between the holes of each pair. Between two of the holes the long side, the spacing is also length X (e.g., between holes C and E, or between D and F).

The system can include two exercise attachments 1401 that can be spaced at three or more different lengths apart. For example, two attachments 1401 can be simultaneously connected to hole pairs [C, D] and [E, F] to provide bars spaced a length X apart. The same attachments can be configured a length Y apart from each other, e.g., by connecting those attachments to hole pairs [E, F] and [G, H], respectively, for achieving a narrower grip. If the user wants a very wide grip, then the user can re-configure the attachments to connect to hole pairs [C, D] and [G, H], which would be spaced length X+length Y apart. If the user wants an even wider grip, the user can re-configure each attachment to connect to the hole pairs at opposite sides across the long edge of the platform, such as to hole pairs [A, B] and [G, H]. In this grip, the attachments would be spaced (2×length Y)+length X.

In some embodiments, length X ranges from 18" to 22". In some embodiments, length X is 20". In some embodiments, length Y ranges from 8" to 12". In some embodiments, length Y is 10". In some embodiments, each of the hole pairs are parallel or perpendicular to other hole pairs, which provides parallel placement of the attachments where the attachments are substantially planar in at least one plane.

Figure 15:
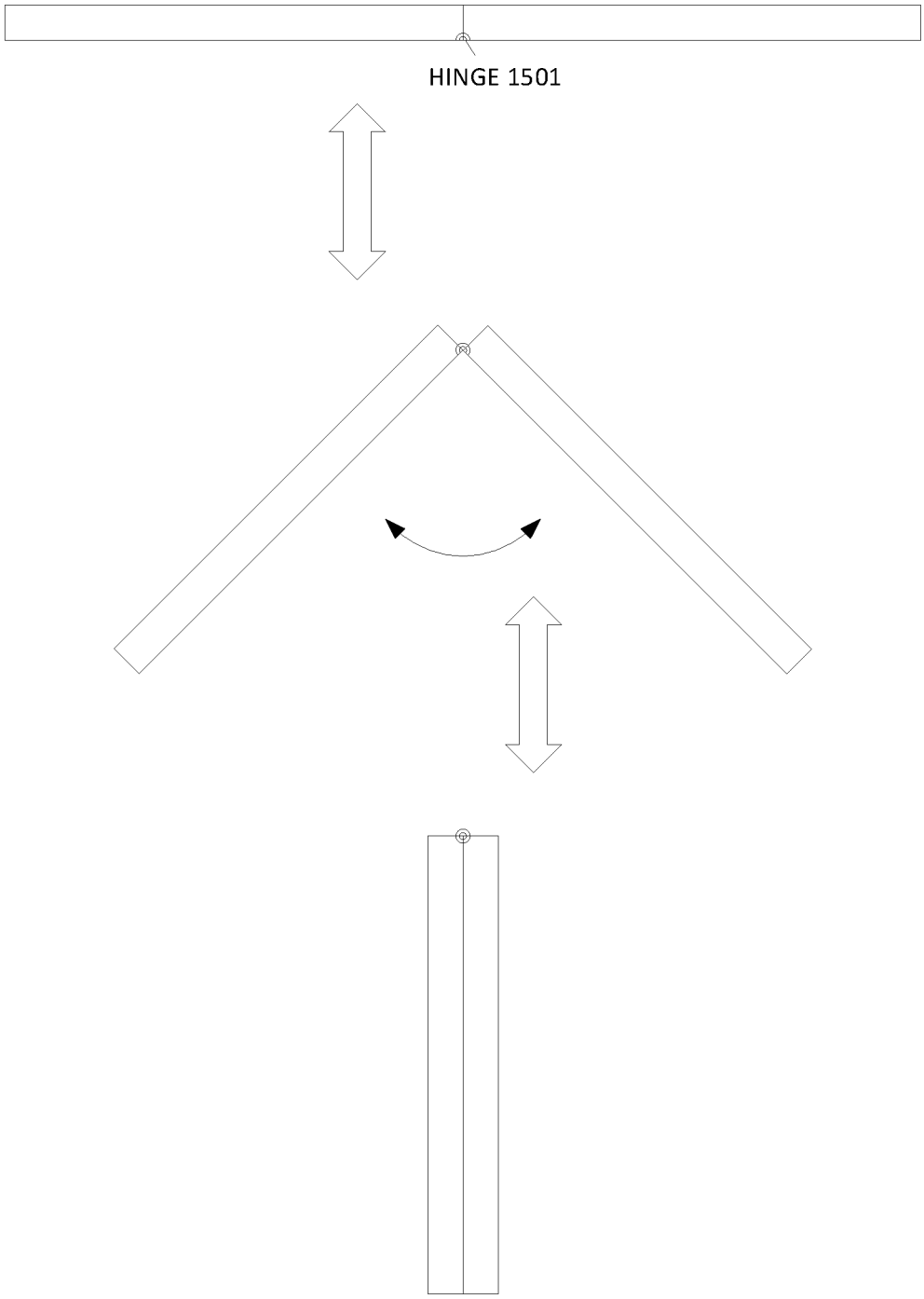
FIG. 15 shows a folding platform of a modular home gym, according to some embodiments.

In some embodiments, the platform can be a folding platform for improved storage and transportation. For example, as shown in FIG. 15, the platform can have a hinge 1501 whereupon the platform can be folded flat. In some embodiments, the fold occurs upon the long edges of the platform, e.g., at or near the halfway point of each of the long edges.

Figure 16:
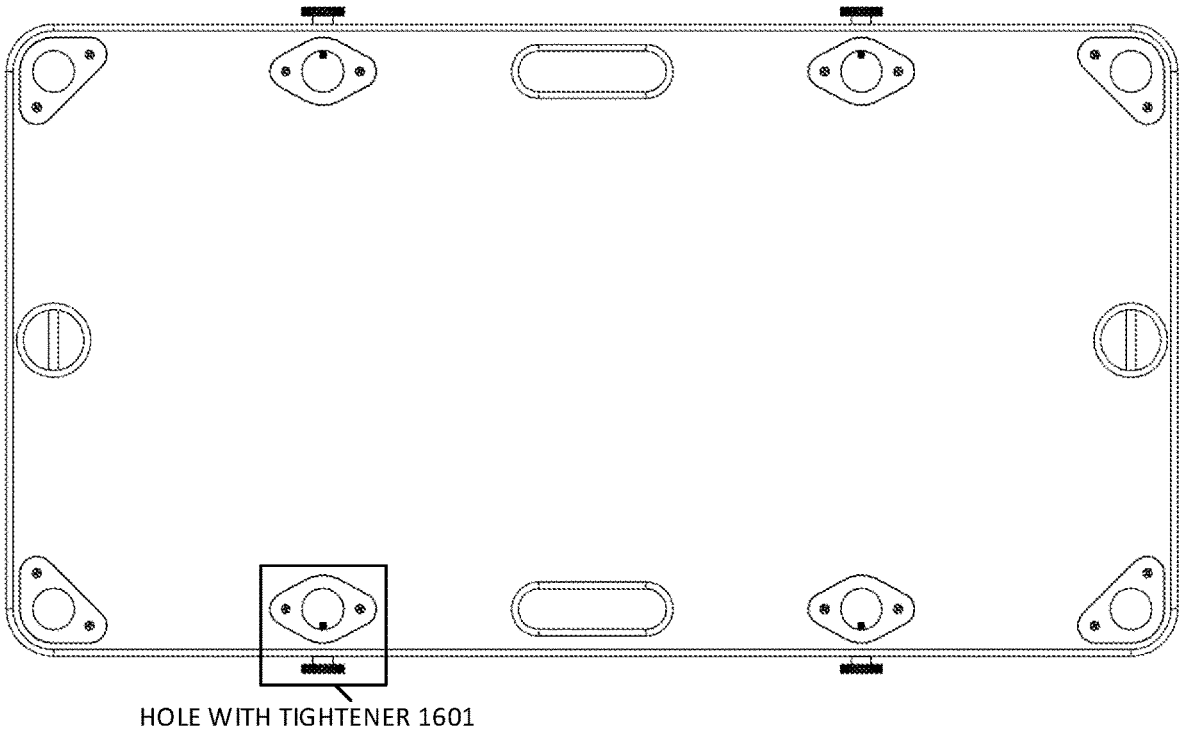
FIG. 16 shows holes of a platform of a modular gym that have tighteners, according to some embodiments.

FIG. 16 shows holes of a platform of a modular gym that has tighteners, according to some embodiments. One or more holes of the platform can have a tightener. In some embodiments, the tightener can include a pin, a screw, an arm, or other mechanical member that applies a force against the attachment when the attachment is arranged in the hole. The force can be a lateral force that presses the attachment against the internal walls of the hole thereby reducing play of the attachment and securing the attachment in the hole. The pin, screw, arm, or other mechanical member can be driven towards the hole based on a spring, a latching lever, or from rotating through threads.

In some examples, the platform has a rectangular shape as shown in FIG. 18. The platform can have eight holes. Four of the holes without tighteners can be positioned on the corners of the platform. The other four holes, with tighteners, can be positioned away from the corners, with two of the four holes along each of the two long sides of the rectangular shape. With this arrangement, the four holes with tighteners can be utilized for tall attachments such as for building a pull up station as shown in FIG. 9.

Figure 17A:
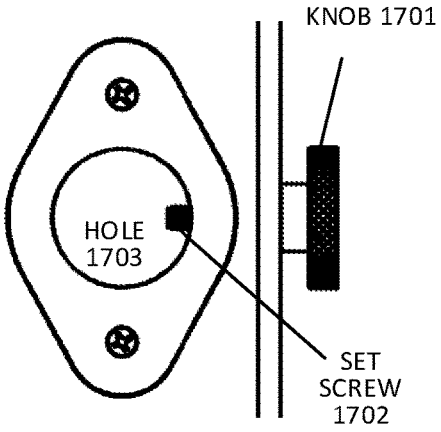
FIG. 17A shows a hole with tightener from top view, according to some embodiments.
Figure 17B:
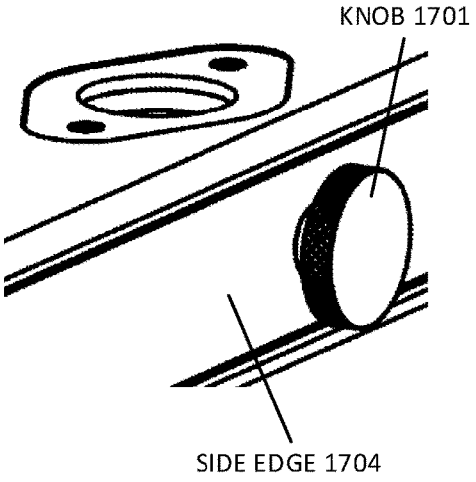
FIG. 17B shows a hole with tightener from a perspective view, according to some embodiments.

FIG. 17A shows a hole with tightener from top view, according to some embodiments. In this example, the tightener can include a knob 1701 that is coupled to a set screw 1702. A user can place the attachment into hole 1703 and turn the knob 1701 to drive the set screw 1702 into the hole. The set screw will push and hold the attachment against the inner walls of the hole, thereby reducing the play and securing the attachment in place. FIG. 17B shows a hole with tightener from a perspective view, according to some embodiments. The knob 1701 can be positioned on a surface of the side edge 1704 of the platform. The side edge can include threads that the set screw turns through when the knob is turned. As discussed, a tightener can include other mechanisms that drive a member towards the hole to hold the attachment in place. While certain embodiments have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. It should also be understood that while some features are shown in the figures with certain embodiments, those features can be combined with other embodiments described in this disclosure and/or shown in different figures.

What is claimed is:

1. A modular home gym comprising:

a rectangular platform having a plurality of holes located on a top facing surface of the platform, wherein the plurality of holes comprises corner holes that are respectively positioned adjacent to each respective corner of the rectangular platform, and wherein the plurality of holes comprises remaining holes positioned away from the respective corners, and wherein each of the remaining holes comprises a respective tightener and each of the corner holes do not comprise a respective tightener; and one or more exercise attachments having one or more mating portions, each mating portion being attachable and removable to a respective one of the plurality of holes of the platform, wherein the one or more exercise attachments includes a first exercise attachment, wherein the first exercise attachment includes a pull-up station that includes a first base portion and a second base portion that each include two of the one or more mating portions that are attachable to the plurality of holes, and a top portion that is raised by and held between the first base portion and the second base portion.

2. The modular home gym of claim 1, wherein the plurality of holes includes exactly eight holes.

3. The modular home gym of claim 2, wherein at least six adjacent hole pairs of the eight holes share a first distance between the holes of each pair of the at least six adjacent hole pairs.

4. The modular home gym of claim 3, wherein at least four adjacent hole pairs of the eight holes share a second distance between the holes of each pair of the at least four adjacent hole pairs, wherein the second distance is half of the first distance.

5. The modular home gym of claim 4, wherein the first distance ranges from 18" to 22".

6. The modular home gym of claim 5, wherein each of the respective tighteners includes at least one of a pin, a screw, or an arm that is configured to apply a force against the one or more exercise attachments.

7. The modular home gym of claim 1, comprising a first stiffener plate arranged over each of the plurality of holes, each first stiffener plate having a channel that allows entrance of the one or more mating portions into the respective hole.

8. The module home gym of claim 7, wherein each channel forms an outer perimeter to an entrance of the respective hole at the top facing surface of the platform.

9. The modular home gym of claim 8, wherein each of the plurality of holes includes a second stiffener plate having a channel that forms a second outer perimeter to a portion of the respective hole that is behind the first stiffener plate that is at the top facing surface of the platform.

10. The modular home gym of claim 1, further including a strap holder.

11. The modular home gym of claim 10, wherein the strap holder includes a strap pin for looping a strap around, the strap pin being fixed within a cavity at the top facing surface of the platform.

12. The modular home gym of claim 11, wherein the strap holder is positioned between two of the corner holes of the plurality of holes that are each positioned at corners of the platform.

13. The modular home gym of claim 1, further comprising support pads positioned on a bottom surface of the platform.

14. The modular home gym of claim 13, wherein the support pads are positioned at each corner of the platform.

15. The modular home gym of claim 13, wherein the support pads are adjustable in height.

16. The modular home gym of claim 1, wherein the one or more exercise attachments further includes a second exercise attachment, wherein the second exercise attachment includes a U-shaped tube, each end of the tube forming one of the one or more mating portions that mate with the corresponding respective one of the plurality of holes.

17. The modular home gym of claim 1, wherein the first base portion, the second base portion, and the top portion are manually separable and attachable without removing fasteners, and the first base portion, the second base portion, and the top portion are planar in at least one dimension when separated.

* * * * *